US009260229B1

(12) United States Patent
Ongchangco

(10) Patent No.: US 9,260,229 B1
(45) Date of Patent: Feb. 16, 2016

(54) LOCKABLE CHILD CONTAINER ASSEMBLY

(71) Applicant: Ira Ongchangco, Monrovia, CA (US)

(72) Inventor: Ira Ongchangco, Monrovia, CA (US)

( * ) Notice: Subject to any disclaimer, the term of this patent is extended or adjusted under 35 U.S.C. 154(b) by 0 days.

(21) Appl. No.: 14/549,183

(22) Filed: Nov. 20, 2014

(51) Int. Cl.
*B65D 55/14* (2006.01)
*E05B 19/14* (2006.01)
*E05B 27/00* (2006.01)

(52) U.S. Cl.
CPC ..... *B65D 55/14* (2013.01); *E05B 19/14* (2013.01); *E05B 27/0085* (2013.01)

(58) Field of Classification Search
CPC .. B65D 55/14; B65D 2555/02; B65D 50/067; E05B 19/0082; E05B 19/14; E05B 19/0064; E05B 35/14; E05B 27/0085; E05B 27/0089; E05B 27/0092; E05B 27/0096; E05B 29/0073; E05B 29/008; E05B 29/0086; E05B 29/0093; E05B 63/0047
See application file for complete search history.

(56) References Cited

U.S. PATENT DOCUMENTS

| | | | | |
|---|---|---|---|---|
| 588,237 | A * | 8/1897 | Parker | 70/71 |
| 3,340,969 | A * | 9/1967 | Rothberg | 190/1 |
| D320,501 | S | 10/1991 | Marks | |
| 5,632,377 | A | 5/1997 | Ferrero | |
| 5,890,595 | A | 4/1999 | Credle, Jr. | |
| 6,488,556 | B2 | 12/2002 | Galomb | |
| 8,528,761 | B2 | 9/2013 | Yarro et al. | |
| 2004/0094610 | A1 | 5/2004 | Longo | |
| 2008/0064290 | A1 | 3/2008 | Castellani | |
| 2010/0200438 | A1 | 8/2010 | Davies | |

FOREIGN PATENT DOCUMENTS

| | | |
|---|---|---|
| WO | WO9926864 | 6/1999 |

* cited by examiner

*Primary Examiner* — Andrew Perreault

(57) ABSTRACT

A lockable child container assembly includes a housing that has a first end wall, a second end wall and a perimeter wall attached to and extending between the first and second ends walls. The housing has a door therein for opening an access aperture in the perimeter wall to allow for accessing of an interior of the housing. A lock is mounted on the housing and releasably locks the door in a closed position covering the access aperture. A mount is attached to the housing and covers a portion of the lock facing outwardly of the housing. A lock actuator is removably mounted on the mount. The lock actuator is extendable through the mount to engage the lock and release door from the closed position. The lock actuator is removably mounted on the mount such that the lock is covered by the lock actuator.

5 Claims, 3 Drawing Sheets

LOCKABLE CHILD CONTAINER ASSEMBLY

BACKGROUND OF THE DISCLOSURE

Field of the Disclosure

The disclosure relates to child container devices and more particularly pertains to a new child container device for providing a combination lockable container and toy for a child.

SUMMARY OF THE DISCLOSURE

An embodiment of the disclosure meets the needs presented above by generally comprising a housing that has a first end wall, a second end wall and a perimeter wall attached to and extending between the first and second ends walls. The housing has a door therein for opening an access aperture in the perimeter wall to allow for accessing of an interior of the housing. A lock is mounted on the housing and releasably locks the door in a closed position covering the access aperture. A mount is attached to the housing and covers a portion of the lock facing outwardly of the housing. A lock actuator is removably mounted on the mount. The lock actuator is extendable through the mount to engage the lock and release door from the closed position. The lock actuator is removably mounted on the mount such that the lock is covered by the lock actuator.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
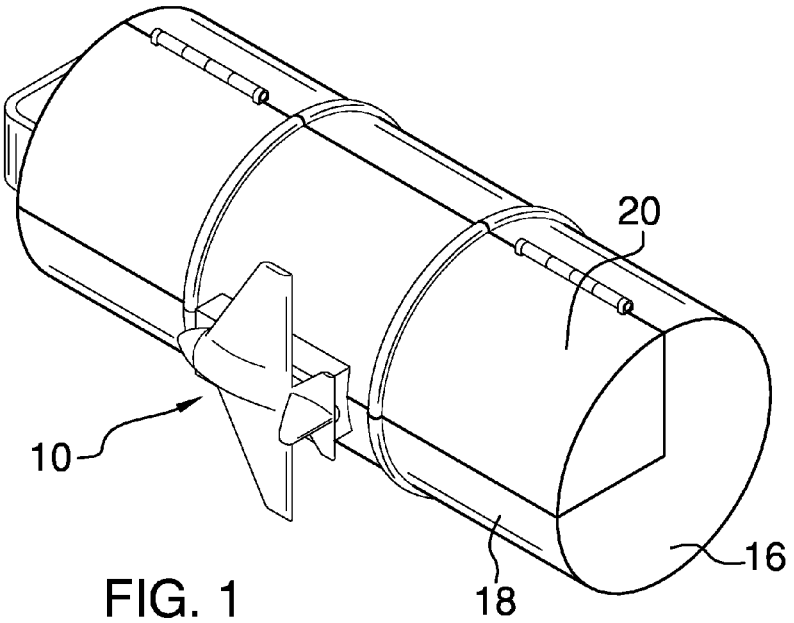
FIG. 1 is a front perspective view of a lockable child container assembly according to an embodiment of the disclosure.
Figure 2:
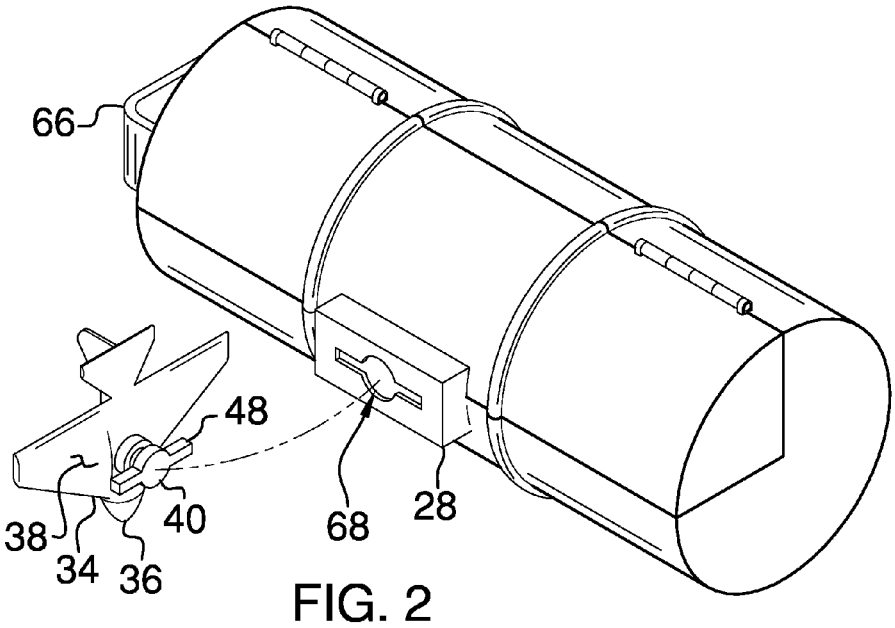
FIG. 2 is a front perspective view of an embodiment of the disclosure.
Figure 3:
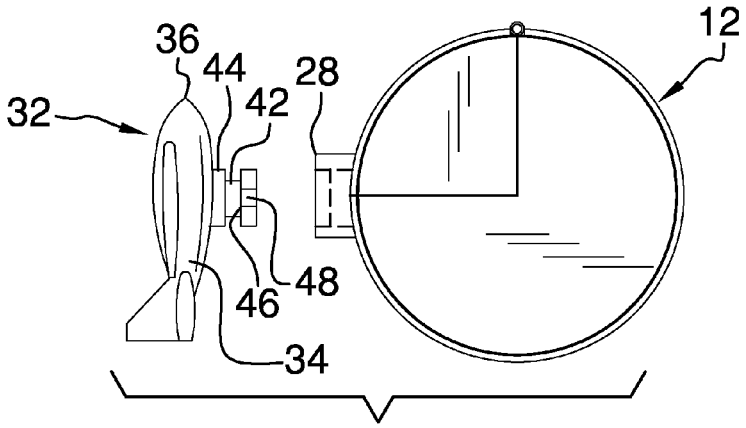
FIG. 3 is a side view of an embodiment of the disclosure.
Figure 4:
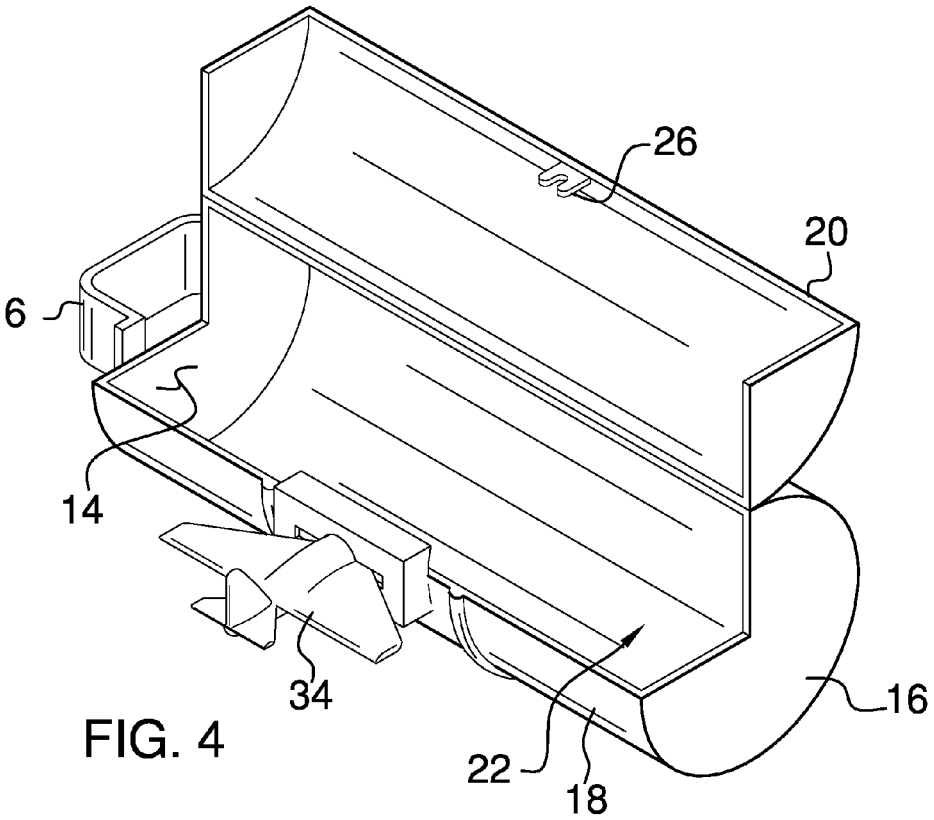
FIG. 4 is a front perspective view of an embodiment of the disclosure.
Figure 5:
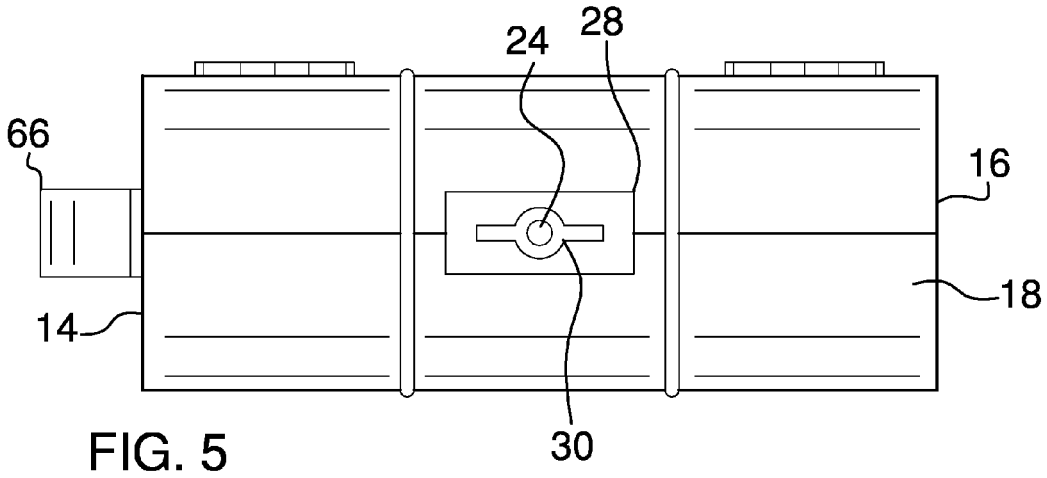
FIG. 5 is a front view of an embodiment of the disclosure.
Figure 6:
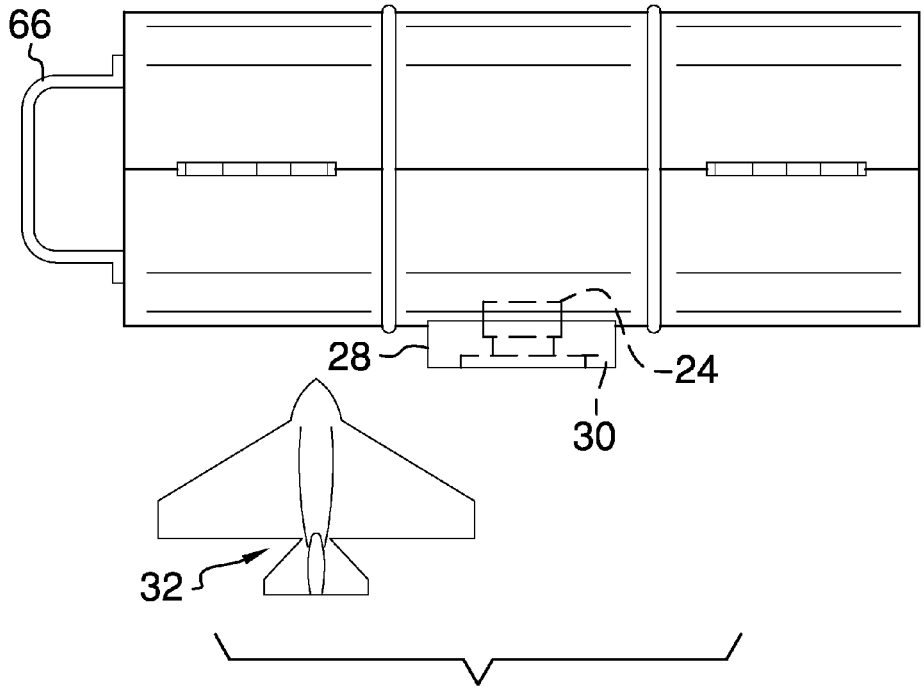
FIG. 6 is a top view of an embodiment of the disclosure.

With reference now to the drawings, and in particular to FIGS. 1 through 6 thereof, a new child container device embodying the principles and concepts of an embodiment of the disclosure and generally designated by the reference numeral 10 will be described.

As best illustrated in FIGS. 1 through 6, the lockable child container assembly 10 generally comprises a housing 12 that has a first end wall 14, a second end wall 16 and a perimeter wall 18 which is attached to and extends between the first 14 and second 16 ends walls. The housing 12 has a door 20 therein for opening an access aperture 22 in the perimeter wall 18 to allow for accessing of an interior of the housing 12. The door 20 extends from the first end wall 14 to the second end wall 16 and the first 14 and second 16 end walls each may have a circular shape. As can be seen in the Figures, the door 20 may include a portion of the first 14 and second end 16 walls to facilitate access into the housing 12. A handle 66 is attached to the housing 12 and may be attached to the first end wall 14.

A lock 24 is mounted on the housing 12 and releasably locks the door 20 in a closed position covering the access aperture 22. The term "lock" is being used, it should be understood that all latching type mechanisms may be used and, as this will be used by a child, in particular push button releases will likely be employed which only require depressing to release a catch 26 on the door 20 and allow it to be opened. A mount 28 is attached to the housing 12 and covers a portion of the lock 24 facing outwardly of the housing. The mount 28 includes a receiver 68 having an elongated opening 30 therein.

A lock actuator 32 is removably mounted on the mount 28. The lock actuator 32 is provided to facilitate the actuation of the lock 30 by the child and is extendable through the mount 28 to engage the lock 30 and release door 20 from the closed position. It should be understood that while the examples herein are utilizing a push button mechanism, a lock 30 which requires the lock actuator 32 to be a keyed structure may also be employed. The lock actuator 32 includes a base 34. The base 34 may specifically be shaped to comprise a child's toy. This allows the child to play with the lock actuator 32 when using the housing 12 and will also encourage the child to replace the lock actuator 32 when the door 20 is closed. A lock engaging portion 36 is attached to a perimeter surface of the base 34. By perimeter surface what is meant is all sides but a bottom surface 38 of the base 36 may be used. As can be seen in the Figures, the example provided places the lock engaging portion 36 on a front surface of the base 38. The lock engaging portion 36 is extendable through the elongated opening 30, which may have a widened central area to receive the lock engaging portion 36, and is abuttable and engageable with the lock 24.

A mount engaging portion 40 is attached to the bottom surface 38 of the base 34. The mount engaging portion 40 includes a post 42 that is attached to and extends away from the bottom surface 38. The post 42 has a first end 44 attached to the base 34 and a second end 46 positioned distal to the base 34. An elongated member 48 is attached to the second end 46 and is oriented perpendicular to the post 42. The elongated member 48 is positionable through the elongated opening 30 when the elongated member 48 and the elongated opening 30 are aligned with each other. The post 42, and base 34, may then be rotated to misalign the elongated member 48 and the elongated opening 30 to retain the elongated member 48 within the mount 28 such that the lock actuator 32 is coupled to the mount 28. In this manner, the lock 24 is covered by the lock actuator 32 when it is not being accessed. Moreover, the child will not readily lose the lock actuator 32 as it will be coupled to the housing 12 when not in use and played with when the lock 24 is to be accessed.

In use, the housing 12 is used in a conventional manner such as for a lunch box or toy holding container. The user places items within the housing 12, closes the door 20 and then places the lock actuator 32 in the mount 28 so that the lock 24 is covered and the lock actuator 32 is coupled to the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A container assembly configured for holding a plurality of articles, said assembly comprising:

a housing having a first end wall, a second end wall and a perimeter wall being attached to and extending between said first and second ends walls, said housing having a door therein for opening an access aperture in said perimeter wall to allow for accessing of an interior of said housing;

a lock being mounted on said housing and releasably locking said door in a closed position covering said access aperture;

a mount being attached to said housing and covering a portion of said lock facing outwardly of said housing, said mount including a receiver having an elongated opening therein;

a lock actuator being removably mounted on said mount, said lock actuator being extendable through said mount to engage said lock and release door from said closed position, said lock actuator being removably mounted on said mount such that said lock is covered by said lock actuator, said lock actuator including a base, a lock engaging portion being attached to a perimeter surface of said base, said lock engaging portion being extendable through said elongated opening and being abuttable and engageable with said lock, and a mount engaging portion being attached to a bottom surface of said base, said mount engaging portion includes a post being attached to and extending away from said bottom surface, said post having a first end attached to said base and a second end positioned distal to said base, a medial point of an elongated member being attached to said second end, said elongated member being oriented perpendicular to said post, said elongated member being positionable in said elongated opening when said elongated member and said elongated opening are aligned with each other, said post being rotated to misalign said elongated member and said elongated opening to retain said elongated member within said mount such that said lock actuator is coupled to said mount; and a handle being attached to said housing, said handle having opposite ends each being attached to said first end wall.

2. The container assembly configured for holding a plurality of articles according to claim 1, wherein said door extends from said first end wall to said second end wall.

3. The container assembly configured for holding a plurality of articles according to claim 2, wherein said first and second end walls each have a circular shape.

4. The container assembly configured for holding a plurality of articles according to claim 1, wherein said base comprises a child's toy.

5. A container assembly configured for holding a plurality of articles, said assembly comprising:

a housing having a first end wall, a second end wall and a perimeter wall being attached to and extending between said first and second ends walls, said housing having a door therein for opening an access aperture in said perimeter wall to allow for accessing of an interior of said housing, said door extending from said first end wall to said second end wall, said first and second end walls each having a circular shape;

a lock being mounted on said housing and releasably locking said door in a closed position covering said access aperture;

a mount being attached to said housing and covering a portion of said lock facing outwardly of said housing, said mount including a receiver having an elongated opening therein;

a lock actuator being removably mounted on said mount, said lock actuator being extendable through said mount to engage said lock and release door from said closed position, said lock actuator including:

a base, said base comprising a child's toy;

a lock engaging portion being attached to a perimeter surface of said base, said lock engaging portion being extendable through said elongated opening and being abuttable and engageable with said lock;

a mount engaging portion being attached to a bottom surface of said base, said mount engaging portion including a post being attached to and extending away from said bottom surface, said post having a first end attached to said base and a second end positioned distal to said base, a medial point of an elongated member being attached to said second end, said elongated member being oriented perpendicular to said post, said elongated member being positionable in said elongated opening when said elongated member and said elongated opening are aligned with each other, said post being rotated to misalign said elongated member and said elongated opening to retain said elongated member within said mount such that said lock actuator is coupled to said mount; and a handle being attached to said housing, said handle being attached to said first end wall.

* * * * *